United States Patent [19]

Mohr

[11] Patent Number: 4,512,294

[45] Date of Patent: Apr. 23, 1985

[54] OUTBOARD MOTOR WITH SELECTIVELY OPERABLE DRAINAGE SYSTEM

[75] Inventor: James W. Mohr, Brookfield, Wis.

[73] Assignee: Outboard Marine Corporation, Waukegan, Ill.

[21] Appl. No.: 576,277

[22] Filed: Feb. 2, 1984

Related U.S. Application Data

[63] Continuation of Ser. No. 408,839, Aug. 17, 1982, Pat. No. 4,461,250, which is a continuation of Ser. No. 119,081, Feb. 6, 1980, abandoned.

[51] Int. Cl.[3] ..... F02B 33/04

[52] U.S. Cl. ..... 123/73 R; 123/198 R; 123/198 A; 440/88; 440/900; 251/297; 137/625.68

[58] Field of Search ..... 123/198 A, 198 R, 198 E, 123/73 A, 73 R; 440/900, 88; 251/297; 137/625.67, 625.68

[56] References Cited

U.S. PATENT DOCUMENTS

| | | | |
|---|---|---|---|
| 1,606,424 | 11/1926 | Irgens et al. | 123/73 R |
| 2,603,236 | 7/1952 | Brown | 251/297 |
| 3,128,748 | 4/1964 | Goggi | 123/73 R |
| 3,132,635 | 5/1964 | Heidner | 123/73 R |
| 3,519,312 | 7/1970 | Cruse | 137/625.67 |
| 3,698,368 | 10/1972 | Yamamoto | 123/73 R |
| 3,709,202 | 1/1973 | Brown | 123/73 R |
| 3,730,149 | 5/1973 | Brown | 123/73 R |
| 3,762,380 | 10/1973 | Schultz | 123/73 R |
| 3,859,967 | 1/1975 | Turner et al. | 123/73 A |
| 3,911,870 | 10/1975 | Hackbarth | 123/DIG. 5 |
| 3,929,111 | 12/1975 | Turner et al. | 123/73 R |
| 3,931,828 | 1/1976 | Lawler | 440/900 |
| 4,088,090 | 5/1978 | Brinton | 440/88 |
| 4,108,190 | 8/1978 | Carlson | 440/900 |
| 4,121,551 | 10/1978 | Turner | 123/73 A |

FOREIGN PATENT DOCUMENTS

| | | | |
|---|---|---|---|
| 83696 | 6/1980 | Japan | 440/900 |

*Primary Examiner*—Ira S. Lazarus
*Assistant Examiner*—R. S. Bailey
*Attorney, Agent, or Firm*—Michael, Best & Friedrich

[57] ABSTRACT

Disclosed herein is an outboard motor comprising a cylinder, a crankcase extending from the cylinder and including an upper portion having a bearing and a lower portion having a drainage outlet, a transfer passage extending between the cylinder and the crankcase, a drains return inlet in one of the cylinder and the transfer passage, a fuel supply system including an inlet manifold communicable with the cylinder and having a drains outlet and a carburetor communicating with the inlet manifold and having a drainage outlet, an overboard drain, and a valve and conduit system selectively operable for communicating the overboard drain with each of the manifold drains outlet, the crankcase drains outlet, and the carburetor drainage outlet, for communicating the crankcase bearing and the drains return inlet with the manifold drains outlet and the crankcase drains outlet, and for closing the carburetor drainage outlet.

11 Claims, 4 Drawing Figures

OUTBOARD MOTOR WITH SELECTIVELY OPERABLE DRAINAGE SYSTEM

This is a continuation application of application Ser. No. 408,839 filed Aug. 17, 1982, U.S. Pat. No. 4,461,250 which is a continuation of application Ser. No. 119,081, filed Feb. 6, 1980, now abandoned.

BACKGROUND OF THE INVENTION

The invention relates to outboard motors and particularly to arrangements for preventing submergence of such motors from permanently rendering such motors inoperable or from preventing starting of such motors. The invention also relates to methods of purging water from outboard motors which have previously been submerged in water.

In this last regard, when an outboard motor is submerged, water can enter into the cylinders and crankcase and into various components of the air and/or fuel supply system, as for instance, the inlet manifold and the carburetor float bowl. Obviously, the presence of water in the cylinder or crankcase and in the inlet manifold or carburetor float bowl provides an impedement to operation to the motor, and particularly to starting thereof.

Attention is directed to the Brinton U.S. Pat. No. 4,088,090 issued May 9, 1978 directed to means for closing the air intake automatically to prevent the ingress of water into an outboard motor in the event of the capsize of the craft to which the outboard motor is fitted. The invention disclosed hereinafter is not particularly directed to preventing the ingress of water into the outboard motor, but toward the drainage of such water from the outboard motor to enable its subsequent starting and operation.

In particular, the invention disclosed herein is directed to facilitating rapid drainage of water from the innards of an outboard motor without resorting to disassembling or dismantling of the outboard motor.

Attention is also directed to the following patents which relate to or disclose internal combustion engines including "drains" recirculation systems:

Irgens U.S. Pat. No. 1,606,424, issued Nov. 9, 1926
Goggi U.S. Pat. No. 3,128,748, issued Apr. 14, 1964
Heidner U.S. Pat. No. 3,132,635, issued May 12, 1964
Brown U.S. Pat. No. 3,709,202, issued Jan. 9, 1973
Brown U.S. Pat. No. 3,730,149, issued May 1, 1973
Schultz U.S. Pat. No. 3,762,380, issued Oct. 2, 1973
Turner U.S. Pat. No. 3,859,967, issued Jan. 14, 1975
Hackbarth U.S. Pat. No. 3,911,870, issued Oct. 14, 1975
Turner U.S. Pat. No. 3,929,111, issued Dec. 30, 1975
Turner U.S. Pat. No. 4,121,551, issued Oct. 24, 1978

SUMMARY OF THE INVENTION

The invention provides an outboard motor comprising a cylinder, air and/or fuel supply means communicable with the cylinder and having a drainage outlet including valve means selectively operable for closing the drainage outlet and for communicating the drainage outlet with the atmosphere for drainage of fluid from the motor.

The invention also provides an outboard motor comprising a cylinder, a crankcase extending from the cylinder, a transfer passage extending between the cylinder and the crankcase, and a drainage outlet located in the crankcase and including valve means selectively operable for closing the drainage outlet and for communicating the drainage outlet with the atmosphere for drainage of fluid from the motor.

The invention also provides an outboard motor comprising a fuel supply system including a carburetor having a float bowl including a valved drainage outlet operable between a closed position and an open position communicating with the atmosphere, and pump means for pumping fuel from a source to the carburetor bowl.

The invention also provides an outboard motor comprising a fuel supply system including a carburetor having an air and/or fuel induction passage communicating through a manifold with the interior of an engine block, which manifold includes a valved drainage outlet operable between a closed position and an open position communicating with the atmosphere.

The invention also provides an outboard motor comprising a fuel supply system including a carburetor having a float bowl including, at the lowermost part thereof, a valved drainage outlet operable between a closed position and an open position communicating with the atmosphere, which carburetor also includes an air-fuel induction passage communicating through a manifold with the interior of an engine block, which manifold includes, at the lowermost part thereof, a valved drainage outlet operable between a closed position and an open position communicating with the atmosphere, and pump means for pumping fuel from a source to the carburetor bowl.

The invention also provides a method of purging water from an outboard motor comprising a cylinder, a crankcase extending from the cylinder, a transfer passage communicable between the cylinder and the crankcase, an exhaust port communicable between the cylinder and the atmosphere, a piston reciprocably movable relative to the cylinder to open and close the exhaust port and to open and close the transfer passage, and a drainage outlet located in the crankcase and including valve means selectively operable for closing the drainage outlet and for communicating the drainage outlet with the atmosphere for drainage of fluid from the motor, which method comprises the steps of opening the drainage outlet and causing reciprocation of the piston to expel water from the crankcase through the drainage outlet and to open the exhaust port so as to communicate the cylinder with the atmosphere through the exhaust port and thereby to permit drainage of fluid from the cylinder through the transfer passage to the crankcase and from the crankcase through the drainage outlet.

The invention also provides a method of purging water from a fuel supply system including a carburetor having a float bowl with a valved drainage outlet operable between a closed position and an open position communicating with the atmosphere, which method comprises the steps of opening the drainage outlet.

The invention also provides a method of purging water from a fuel supply system including a carburetor having an air-fuel induction passage communicating through a manifold with the interior of an engine block, which manifold includes a valved drainage outlet operable between a closed position and an open position communicating with the atmosphere, which method comprises the steps of opening the manifold drainage outlet.

The invention also provides a method of purging water from a fuel supply system comprising a carburetor having a float bowl including, at the lowermost part thereof, a valved drainage outlet operable between a closed position and an open position communicating with the atmosphere, which carburetor also includes an air-fuel induction passage communicating through a manifold with the interior of an engine block, which manifold includes, at the lowermost part thereof, a valved drainage outlet, and pump means for pumping fuel from a source to the carburetor bowl, which method comprises the steps of opening the manifold drainage outlet, opening the bowl drainage outlet, and operating the pumping means to purge water from the bowl through the valved outlet to the atmosphere.

The invention also provides an outboard motor comprising a cylinder, fuel supply means communicable with the cylinder and having a drainage outlet, an overboard drain, and valve and conduit means operative selectively for communicating the fuel supply drainage outlet with the overboard drain and for closing the fuel supply drainage outlet.

The invention also provides an outboard motor comprising a cylinder, a crankcase extending from the cylinder and including a drains outlet, a transfer passage extending between the cylinder and the crankcase, a drains return inlet in one of the cylinder, the crankcase, and the transfer passage, an overboard drain, and valve and conduit means selectively operable for communicating the crankcase drains outlet with the overboard drain and for communicating the crankcase drains outlet with the drains return inlet.

The invention also provides an outboard motor comprising a cylinder, a crankcase extending from the cylinder and including a drains outlet, a transfer passage extending between the cylinder and the crankcase, a drains return inlet in one of the cylinder, the crankcase, and the transfer passage, a carburetor communicable with the cylinder and having a drainage outlet, an overboard drain, and valve and conduit means selectively operable for communicating the overboard drain with each of the crankcase drains outlet and the carburetor drainage outlet, for communicating the drains return inlet with the crankcase drains outlet, and for closing the carburetor drainage outlet.

The invention also provides an outboard motor comprising a cylinder, a crankcase extending from the cylinder and including an upper portion having a bearing and a lower portion having a drainage outlet, a transfer passage extending between the cylinder and the crankcase, a drains return inlet in one of the cylinder and the transfer passage, a fuel supply system including an inlet manifold communicable with the cylinder and having a drains outlet and a carburetor communicating with the inlet manifold and having a drainage outlet, an overboard drain, and valve and conduit means selectively operable for communicating the overboard drain with each of the manifold drains outlet, the crankcase drains outlet, and the carburetor drainage outlet, for communicating the crankcase bearing and the drains return inlet with the manifold drains outlet and the crankcase drains outlet, and for closing the carburetor drainage outlet.

In accordance with one embodiment of the invention, the valve and conduit means includes a valve housing having therein an elongated valve chamber, first and second drains inlet ports communicating with the chamber in spaced relation to each other and with the manifold drains outlet and with the crankcase drains outlet, port means communicating with the chamber and with the crankcase bearing and the drains return inlet, a drains overboard port communicating with the chamber in spaced relation to the port means and with the overboard drain, a carburetor drainage inlet port communicating with the chamber and with the carburetor drainage outlet, a carburetor drainage overboard port communicating with the chamber and with the overboard drain, and a valve member movable in the valve chamber between a run position and a drain position, which valve member includes means cooperating with the ports so that, when the valve member is in the run position, the first drains inlet port is in communication with the port means, and said second drains inlet port and the carburetor drainage inlet port are blocked by the valve member and, when the valve member is in the drain position, the second drains inlet port communicates with the drains overboard port, the carburetor drainage inlet port communicates with the carburetor drainage overboard port, and the first drains inlet port is blocked by the valve member.

Other features and advantages of the embodiments of the invention will become apparent upon review of the following general description and the appended claims.

Figure 1:
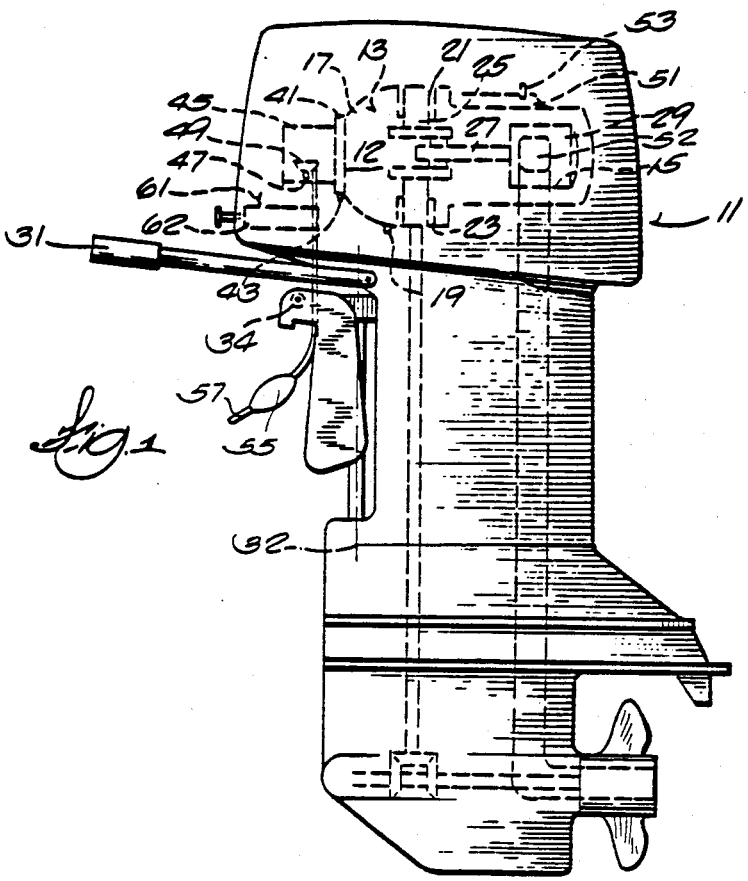
FIG. 1 is a side elevational view of an outboard motor which embodies various of the features of the invention and which includes some parts shown schematically.

Before explaining various of the embodiments of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is an outboard motor 11 which includes an engine 12 comprising a power head or block 13 including one or more cylinders 15. Extending from the cylinders 15 are respective crankcases 17 which can individually or collectively include a valved drains outlet or outlets 19 which are preferably located in the lowermost part or area of the associated crankcase 17 where heavy condensed components of the incoming vaporized fuel (sometimes referred to as "drains") tend to collect and accumulate. It is understood that the valved outlet 19 is in addition to any valved arrangement for supplying fuel and/or air to the crankcases 17 such as, for instance, by conventional reed valves and/or piston controlled air inlet ports. The valved outlet 19 is manually selectively operable between a closed position affording normal engine operation (in the absence of water) and an open position affording drainage of water from the crankcase.

Supported in the crankcase 17 are upper and lower bearings 21 and 23, respectively, which journal a crankshaft 25 which, in turn, is drivingly connected by one or more connecting rods 27 to respective pistons 29 reciprocably movable in the cylinders 15. A tiller 31 is connected to the power head 13 for steering of the outboard motor 11 relative to a boat (not shown) about a steering axis 32. The power head 13 is also preferably connected to the boat for tilting about a horizontal axis 34.

The engine 12 also includes an air and/or fuel supply means communicable with the cylinder or cylinders 15 and including one or more valved drainage outlets. While various constructions can be employed, in the illustrated construction, the fuel supply means includes an inlet manifold 41 connected to the crankcase or crankcases 17 and having, preferably in the lowermost part thereof, a valved drains outlet 43 in the region where heavy condensed components ("drains") of the incoming vaporized fuel supply have a tendency to accumulate or collect. The fuel supply means also includes one or more carburetors 45 communicating with the inlet manifold 41, which carburetors 45 include a valved drainage outlet 47 for draining fluid therefrom. While various arrangements can be provided, in the disclosed construction, the carburetor 45 includes a float bowl 49 (shown schematically) which includes, preferably at the lowermost part thereof, the drainage outlet 47.

The valved outlets 43 and 47 are each manually selectively operable between a closed position affording normal engine operation (in the absence of water) and an open position affording drainage of water from the crankcase. It is understood that the valved outlet 47 is in addition to communication of the float bowl 49 with a valved source of incoming fuel and valved arrangements for supplying fuel to the air/fuel induction passage of the carburetor 45.

While it is preferable that the valved outlets 19, 43 and 47 are preferably located at the lowermost portions of the associated structure, the valved outlets 19, 43 and 47 can be located in other areas if desired to facilitate drainage from the motor and subsequent closure to permit normal engine operation after drainage. Various types of valved outlets can be employed. For instance, a simple valved outlet could comprise a threaded hole with a threaded plug adapted for insertion and withdrawal by a screwdriver or having a thumb knob facilitating manual threaded insertion or withdrawal. Alternatively, a simple rotary valve or cock could be employed. Even a simple plastic snap-on cap or cover could be used, as on the neck of a bottle or container, as is common, for instance, in medicinal containers.

The air and/or fuel supply means also includes the beforementioned crankcase or crankcases 17, and, for each cylinder, one or more transfer passages 51 which extend between the cylinders 15 and the associated crankcases 17 and which are opened and closed in response to piston reciprocation. In addition, the engine includes one or more exhaust ports 52 which are opened and closed by piston reciprocation and which communicate with the atmosphere. In addition, it is preferred to use a waterproofed capacitor discharge ignition system as compared to a breaker point ignition system in order to take advantage of the higher potentials available with a capacitor discharge system and to avoid the use of breaker points.

In operation in accordance with the method of the invention, after the motor 11 is removed from the water, each of the valved outlets 19 is opened to afford communication with the atmosphere. In addition, the pistons 29 are desirably reciprocated, as for instance, by the usual starting mechanism, so as to open the transfer passage 51 and the exhaust ports 52, thereby communicating the cylinders 15 with the atmosphere to facilitate drainage of water from the cylinders 15 through the transfer passages 51 and out of the crankcases 17 through the valved outlets 19.

In addition, the valved outlet 43 is opened to drain the inlet manifold 41, it being understood that the inlet manifold 41 is also open to the atmosphere through the opening in the usual carburetor air induction passage (not shown). Still further in addition, the valved outlet 47 is opened to permit drainage or purging of water from the float bowl 49. In this last regard, it is desirable to insure removal of water from the float bowl 49 by purging thereof as by flushing with fuel through the valved outlet 47. Such flushing can be accomplished by pumping fuel to the float bowl 49 by suitable pumping means such as, for instance, a flexible bulb 55 included in a fuel supply line 57 extending from a fuel source (not shown) to the carburetor 45.

After drainage is complete, the valved outlets 19, 43 and 47 are again closed so as to permit normal engine operation.

It also should be noted that the valved outlets 17, 43, 49 contemplated herein differ from those of the Heidner U.S. Pat. No. 3,132,635 and other like patents in that the valved outlet ports 19 (as well as the valved outlets 43 and 47) do not operate automatically in response to pressure but are manually opened and closed by operator manipulation and communicate with the atmosphere to afford overboard discharge. Furthermore, it is to be noted that drainage can be rapidly accomplished without disassembling or disconnecting or otherwise in any way (except for opening and closing of the valved outlets 19, 43 and 47) rendering the outboard motor temporarily inoperable. Still further, drainage can be obtained when the engine is in upright position.

Figure 2:
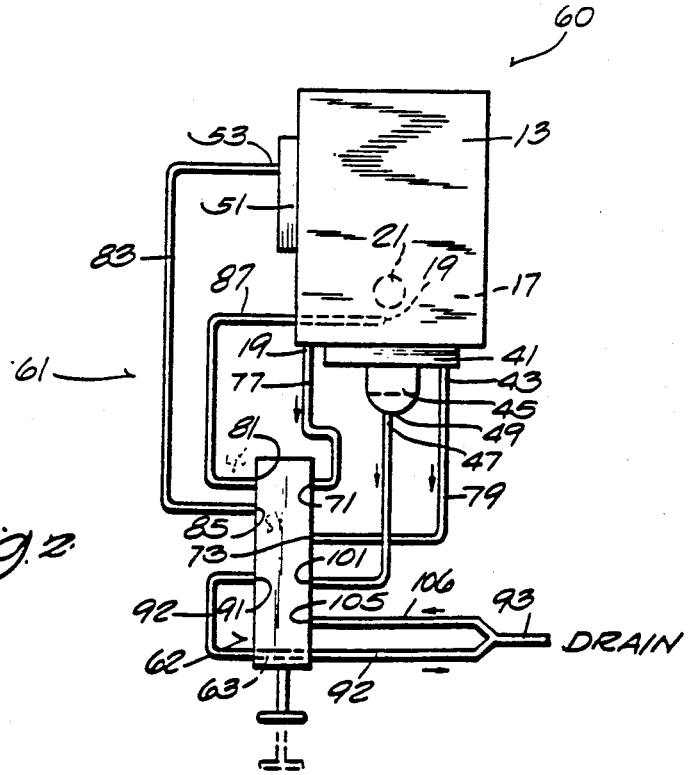
FIG. 2 is a schematic view of another embodiment of an outboard motor which also comprises various of the features of the invention and which is similar to the outboard motor shown in FIG. 1.

Shown in FIG. 2 is another embodiment of an outboard motor 60 which is substantially identical to the outboard motor 11 shown in FIG. 1, except that the outlets 19, 43 and 47 are not valved and in that a combined valve and conduit means is selectively employed to drain water from the motor innards and, during normal engine operation, to afford conveyance of fuel "drains" to drain inlets in the motor so that such "drains" may be used for lubricating purposes and/or supplied to the cylinder or cylinders for combustion.

In this last regard, the engine of the outboard motor shown schematically in FIG. 2 also includes a drains return inlet 53 which can communicate directly with a cylinder 15 or with a transfer passage 51 or with a crankcase and which is intended, under normal running conditions, to afford return of the "drains" deposited in the fuel supply system to the cylinder 15 for combustion.

As indicated above, in order to provide for a normal running condition and also to enable drainage of fluids, such as water, from the air and/or fuel supply system after engine submergence and preferably from the crankcase 17, the inlet manifold 41, and the carburetor 45, the outboard motor shown in FIG. 2 is provided with a valve and conduit means 61 (see FIGS. 2, 3, and 4) operable selectively to afford (during normal running) drainage from the air and/or fuel supply means and conveyance of the drained fluids to either the upper bearing 21 in the crankcase 17 and/or to a cylinder 15 for combustion, as well as closing off of drainage from the carburetor 45 and/or carburetor bowl 49, and also to afford drainage of water from the engine 13, and particularly from the crankcase 17, the inlet manifold 41, and the carburetor 45. While various arrangements can be employed, in the illustrated construction, the valve and conduit means 61 is incorporated into the "drains" recirculation system and comprises a valve 62 which is suitably mounted on the outboard motor 11 and which includes a valve body 63 having an elongated cylindrical bore or chamber 65, together with a valve member 67 reciprocably movable in the chamber 65 in the direction of elongation thereof between a right or "run" position shown in FIG. 3 and a left or "drain" position shown in FIG. 4. In addition, the valve and conduit means 61 includes a plurality of ports communicating with the chamber 65 and associated conduits. More specifically, the plurality of ports and conduits include first and second drains inlet ports 71 and 73, respectively, which are spaced from each other in the direction of chamber elongation and which communicate with a manifold duct 75 which, in turn, communicates through conduits 77 and 79 with the intake manifold drains outlet 43 and/or the crankcase drains outlet or outlets 19.

Figure 3:
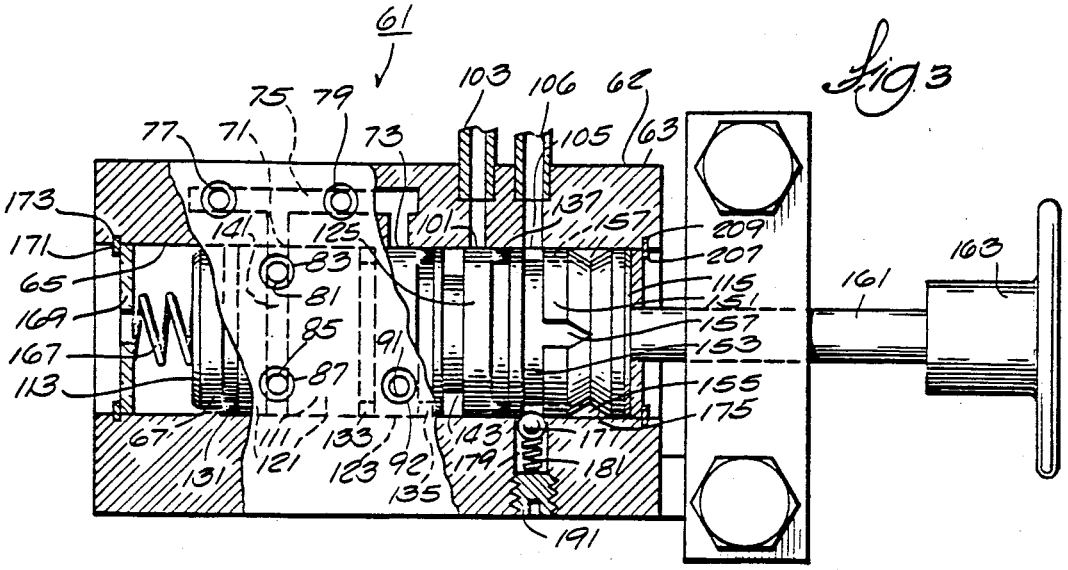
FIG. 3 is an enlarged, partially broken away and sectional view of the valve employed in the outboard motor shown in FIG. 2, with the valve member located in a run position.
Figure 4:
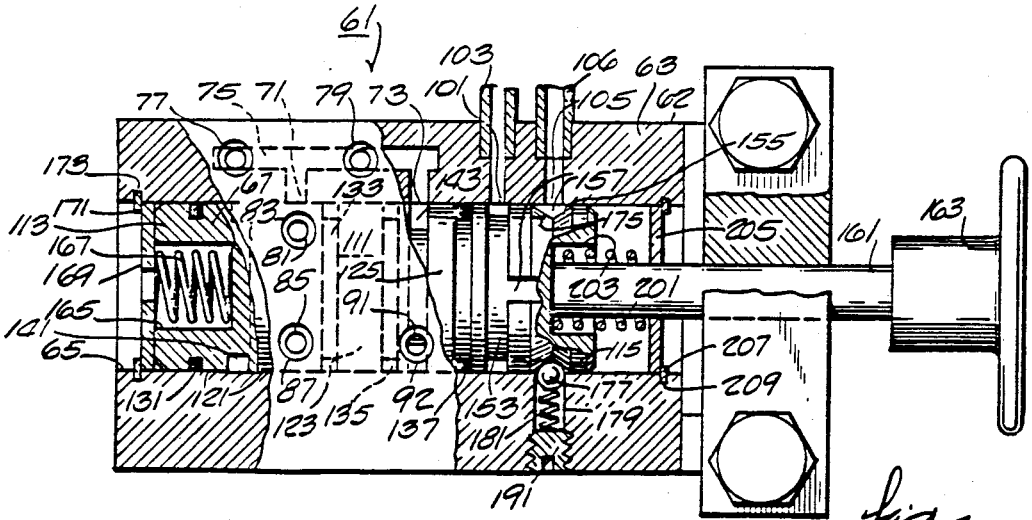
FIG. 4 is a view similar to FIG. 3, with the valve member located in a drain position.

Also included in the plurality of ducts is port means for communicating the chamber 65 with the crankcase upper bearing 21 and the drains return inlet 53. While various arrangements can be employed, in the illustrated construction, the port means is located as shown in FIGS. 3 and 4 in generally the same plane transverse to the elongation of the valve chamber 65 as the first drains inlet port 71 and includes a first drains return port 81 which communicates through a conduit 83 with the drains return inlet 53 and a second drains return port 85 which communicates with the uppercrank case bearing 21 through a conduit 87. If desired, one drain return port could be employed with two branches communicating with the conduits 83 and 87, or all of the drained fluid could be returned through a single port and conduit to either the crankcase upper bearing 21 or the drains return inlet 53 or elsewhere for conveyance to the cylinder 15 for combustion.

The plurality of ports also includes a drains overboard port 91 which is located in generally the same plane transverse to the elongation of the valve chamber 65 as the second drains inlet port 73 and which communicates through a duct or conduit 92 with an overboard drain 93 which can be of any desirable construction and which serves to communicate fluids from the valve to the exterior environment.

The plurality of ports also includes a carburetor drainage inlet port 101 which communicates through a conduit 103 with the carburetor float bowl drainage outlet 47, together with a drainage overboard port 105 which is axially spaced from the carburetor drainage inlet port 101 at about the same spacing as the first and second drains inlet ports 71 and 73 and which communicates through a duct or conduit 106 with the overboard drain 93.

The valve member 67 comprises a generally cylindrical spool 111 having a left end 113 and a right end 115 and, in sequence, beginning adjacent to the left end 113, first, second and third lands 121, 123 and 125 which are defined between four spaced o-rings 131, 133, 135, and 137 which are arranged between the spool 111 and the wall of the chamber 65 to prevent fluid flow therebetween.

The first land 121 is located to block the first drains inlet port 71 when the valve member 67 is in the left or drain position (FIG. 4). In addition, the first land 121 includes an annular groove 141 which is located to afford communication between the first drains inlet port 71 and the first and second drains return ports 81 and 85 when the valve member 67 is in the right or run position (FIG. 3).

The second land 123 is located to block the second drains inlet port 85 when the valve member 67 is in the run position.

The third land 125 includes an annular groove 143 which is located to afford communication between the second inlet drains port 85 and the drains overboard port 91 when the valve member 67 is in the left or drain position. In addition, the third land 125 is also located to block the carburetor drainage inlet port 101 when the valve member 67 is in the run position.

The spool or valve member 67 also includes, adjacent the right end 115, a portion 151 including axially extending conduit and duct means which communicates between the carburetor drainage inlet port 101 and the drainage overhead port 105 when the valve member 67 is in the drain or left position. While various constructions can be employed, in the illustrated construction, the portion 151 includes an annular groove 153 which is located for connection with the carburetor drainage inlet port 101 when the valve member 67 is in the drain or left position and a second annular groove 155 which is located for connection with the drainage overboard port 105 when the valve member 67 is in the drain or left position (FIG. 4). Connection of the annular grooves 153 and 155 is provided by one or more peripheral axially extending ducts 157.

Fixedly extending from the right end 115 of the valve member 67 and outwardly from the valve body 63 is a handle shaft 161 which, at its outer end, includes a handle knob 63 facilitating manual movement of the valve member 67 to the left or drain position and release of the valve member 67 from the left or drain position.

Means are provided for normally biasing the valve member 67 toward the right or run position. While various arrangements can be employed, in the illustrated construction, such means comprises an axial recess 165 in the left end 113 of the valve member 67, and a left or main biasing spring 167 which, at is inner end, bears against the left valve member end 113, at its outer end, bears against a washer 169 which closes the left end of the chamber 65 and which is retained in place by a snap ring 171 located in an annular groove 173 in the valve body 63.

Detent means are provided for releasably holding the valve member 67 in the drain or left position. While various arrangements can be employed, in the illustrated construction, such means comprises formation of the second annular groove 155 with at least one inclined ramp surface 175 adapted to cooperate with a detent ball 177 which is at least partially located in a radially extending bore 179 which communicates with the chamber 65 and which is located in angularly spaced relation from the drainage overboard port 165. The detent means also includes a spring 181 which is located in the bore 179 and which bears, at one end, against the ball 177 and, at the other end, against a plug 191 closing the bore 179, thereby biasing the ball 177 outwardly of the bore 179 and into partial receipt in the annular groove 155 (see FIG. 4) so as to releasably restrain movement of the valve member 67 from the drain or left position.

The detent means also includes a second or right spring 201 which surrounds the handle shaft 161 and which is seated, at one end, in an axial recess 203 concentric with the handle shaft 161 at the right end 115 of the valve member 67 and which, at its other end, bears against a washer 205 which closes the right end 115 of the chamber 65 and which is retained in place by a snap ring 207 located in an annular groove 209 in the valve body 63.

The right spring 201 serves to bias the valve member 67 toward the left or drain position. However as the right spring 201 is less powerful than the left or main biasing spring 167, the main biasing spring 167 will overpower the right spring 201 except during the occurrence of an additional force restraining movement of the valve member 67 from the left or drain position (FIG. 4), such as provided by engagement in the groove 155 of the ball 177 under the influence of the spring 181. Thus, operator activity is required to move the valve member 67 from the right or run position to the left or drain position against the action of the main biasing spring 167 and to initially overpower the detent means to relocate the ball 177 in the bore 179 and permit return of the valve member 67 to the right or run position under the operation of the main or left biasing spring 167.

From the foregoing, it is believed to be clear that location of the valve member 67 in the right or run position serves to provide communication between the manifold drains outlet 43 and the crankcase drains outlet 19 with both the upper crankcase bearing 21 and the drains return inlet 53 which communicates through the transfer passage 51 with the cylinder 15. In addition, when the valve member 67 is in the right or run position, the carburetor drainage outlet 47 is blocked by the third land 125 to prevent drainage of any fluid in the carburetor. Still further in addition, the second drains inlet port 73 communicating with the manifold drains outlet 43 and with the crankcase drains outlet 19 is blocked by the second land 123 of the valve member 67.

Location of the valve member 67 in the drain or left position serves to communicate the manifold drains outlet 43 and the crankcase drains outlet 19 with the drains overboard port 91 and to communicate the carburetor drainage inlet port 101 with the drainage overboard port 105 so as to provide for drainage of fluids, such as water from the manifold 41, crankcase 17, and carburetor 45 to the overboard drain 93.

If desired, the engine 12 can be tilted about its horizontal axis 34 to locate the drain valve 62 and overboard drain 93 below the crankcase 17 and carburetor 45 so as thereby to afford gravity drainage from both the crankcase 17 and carburetor float bowl 49. In addition, the squeeze bulb 55 normally provided in the fuel supply line 57 between the carburetor 45 and the fuel tank (not shown) can be employed to pump fuel through the carburetor 45 so as to flush any water from the carburetor 45. In addition, the engine 12 can be cranked, as by the usual pull rope starter (not shown), or otherwise, to assist in pumping from the crankcase 17 any water therein.

In addition, if desired, the handle 163 can extend from the left end 113 of the valve member 67. Under such circumstances, the run position would be an "in" position and the valve member 67 would be moved "out" of the valve body 63 when the spool 111 is moved to the left or drain position.

Various of the features of the invention are set forth in the following claims.

I claim:

1. A valve for an ouboard motor including a cylinder, a crankcase extending from said cylinder and including an upper portion having a bearing and a lower portion having a drains outlet, a transfer passage extending between said cylinder and said crankcase, a drains return inlet in one of said cylinder and said transfer passage, an overboard drain, and a fuel supply system including an inlet manifold communicable with said cylinder and having a drains outlet, and a carburetor communicating with said inlet manifold and having a drainage outlet, said valve comprising a valve housing having therein an elongated valve chamber, first and second drains inlet ports communicating with said chamber in spaced relation to each other and adapted to communicate with said manifold drains outlet and with said crankcase drains outlet, port means communicating with said chamber and adapted to communicate with said crankcase bearing and said drains return inlet, a drains overboard port communicating with said chamber in spaced relation to said port means and adapted to communicate with said overboard drain, a carburetor drainage inlet port communicating with said chamber and adapted to communicate with said carburetor drainage outlet, a carburetor drainage overboard port communicating with said chamber and adapted to communicate with said overboard drain, and a valve member movable in said valve chamber between a run position and a drain position, said valve member including means cooperating with said ports so that, when said valve member is in said run position, said first drains inlet port is in communication with said port means, and said second drains inlet port and said carburetor drainage inlet port are blocked by said valve member and, when said valve member is in said drain position, said second drains inlet port communicates with said drains overboard port, said carburetor drainage inlet port communicates with said carburetor drainage overboard port, and said first drains inlet port is blocked by said valve member.

2. A valve in accordance with claim 1 wherein said valve member includes a first land which is located to block said first drains inlet port when said valve member in said drain position and which includes means communicating between said first drains inlet port and said port means when said valve member in said run position, a second land which is located to block said second drains inlet port when said valve member is in said run position, a third land which is located to block said carburetor drainage inlet port when said valve member is in said run position and which includes means communicating between said second drains inlet port and said drains overboard port when said valve member is in said drain position, and an additional portion including duct means located for communication between said carburetor drainage inlet port and said carburetor drainage overboard port when said valve member is in said drain position.

3. A valve in accordance with either of claims 1 and 2 wherein said port means comprises a crankcase bearing return port communicating with said chamber and with said crankcase upper bearing, and a drains return port communicating with said chamber and with said drains return inlet.

4. A valve in accordance with claim 1 wherein said valve includes means biasing said valve member toward said run position.

5. A valve in accordance with claim 1 wherein said valve includes detent means releasably holding said valve member in said drain position.

6. A valve for an outboard motor including a cylinder, a crankcase extending from said cylinder and including an upper portion having a bearing and a lower portion having a drains outlet, a transfer passage extending between said cylinder and said crankcase, a drains return inlet in one of said cylinder and said transfer passage, an overboard drain, and a fuel supply system including an inlet manifold communicable with said cylinder and having a drains outlet, said valve comprising a valve housing having therein an elongated valve chamber, first and second drains inlet ports communicating with said chamber in spaced relation to each other and adapted to communicate with said manifold drains outlet and with said crankcase drains outlet, port means communicating with said chamber and adapted to communicate with said crankcase bearing and said drains return inlet, a drains overboard port communicating with said chamber in spaced relation to said port means and adapted to communicate with said overboard drain, and a valve member movable in said valve chamber between a run position and a drain position, said valve member including means cooperating with said ports so that, when said valve member is in said run position, said first drains inlet port is in communication with said port means, and said second drains inlet port is blocked by said valve member and, when said valve member is in said drain position, said second drains inlet port communicates with said drains overboard port, and said first drains inlet port is blocked by said valve member.

7. A valve in accordance with claim 6 wherein said valve includes means biasing said valve member toward said run position.

8. A valve in accordance with claim 6 wherein said valve includes detent means releasably holding said valve member in said drain position.

9. A valve for an outboard motor including an engine having a drains outlet, and a drains return inlet, and an overboard drain, said valve comprising a valve housing having therein an elongated valve chamber, first and second drains inlet ports communicating with said chamber in spaced relation to each other and adapted to communicate with said engine drains outlet, port means communicating with said chamber and adapted to communicate with said engine drains return inlet, a drains overboard port communicating with said chamber in spaced relation to said port means and adapted to communicate with said overboard drain, and a valve member movable in said valve chamber between a run position and a drain position, said valve member including means cooperating with said ports so that, when said valve member is in said run position, said first drains inlet port is in communication with said port means, said second drains inlet port is blocked by said valve member and, when said valve member is in said drain position, said second drains inlet port communicates with said drains overboard port, and said first drains inlet port is blocked by said valve member.

10. A valve in accordance with claim 9 wherein said valve includes means biasing said valve member toward said run position.

11. A valve in accordance with claim 9 wherein said valve includes detent means releasably holding said valve member in said drain position.

* * * * *